United States Patent [19]

Magnuson

[11] Patent Number: 4,510,724

[45] Date of Patent: Apr. 16, 1985

[54] BUILDING STRUCTURE

[76] Inventor: Karl Magnuson, Rte. 1, Ewen, Mich. 49925

[21] Appl. No.: 310,890

[22] Filed: Oct. 13, 1981

[51] Int. Cl.[3] ..... E04B 1/10

[52] U.S. Cl. ..... 52/233; 52/284; 52/286

[58] Field of Search ..... 52/233, 284, 286, 574; 46/20

[56] References Cited

U.S. PATENT DOCUMENTS

| | | | |
|---|---|---|---|
| 3,034,938 | 5/1962 | Puhr | 52/574 X |
| 3,676,969 | 7/1972 | Moore | 52/233 |
| 3,818,653 | 6/1974 | Williams | 52/233 X |
| 3,908,322 | 9/1975 | Shoaf | 52/233 X |
| 4,034,527 | 7/1977 | Jalasjaa | 52/233 |

FOREIGN PATENT DOCUMENTS

| | | | |
|---|---|---|---|
| 1264019 | 5/1961 | France | 52/574 |
| 82459 | 9/1953 | Norway | 52/233 |
| 25941 | 11/1908 | Sweden | 52/592 |

*Primary Examiner*—Alfred C. Perham
*Attorney, Agent, or Firm*—Dennis J. Verhaagh

[57] ABSTRACT

A building structure having walls constructed of matched pairs of dimensionally diverse timbers is disclosed which incorporates the natural taper of the timbers and uses a uniform notching system for corner joinder.

4 Claims, 6 Drawing Figures

BUILDING STRUCTURE

FIELD OF THE INVENTION

This invention pertains to log wall-type construction. Unlike the "round log" cabin that was commonly considered to be a temporary structure, the "hewn log" building was often selected by early settlers in North America for their permanent dwelling. The traditional structure employs (and this is its identifying feature) a meeting—at a corner and in a staggered relation—of timbers that have been hewn "square" to a more or less uniform dimension. The corner notching system varies somewhat within the tradition. But usually a dove-tail joint was employed, often with a compound bevel. It was evidently considered desirable to preserve a uniform appearing notch system. Thus, small (and often not so small) variations in the size of the timbers are reflected in variations in the size of the gap between timbers which, in extreme cases, measures 2 inches (5 centimeters) and more. These gaps had to be chinked, an operation that took place preferably after the structure had stood in the open air for a time to allow shrinking and settling. Then "hewn log" building had definite advantages over the "round log" cabin. Its uniformly thick walls gave, when well chinked, a reasonably good insulation value. Its interlocking corner system provided a structure that was reasonably stable and required minimal pinning or nailing at corners. Its flat outside surfaces facilitated the placement of exterior siding. Its flat inner walls likewise facilitated interior finishing, plastering or paneling.

DESCRIPTION OF THE PRIOR ART

The state of the prior art appears to be well-described in U.S. Pat. No. 3,979,862 to Hamilton et al. and the discussion above.

SUMMARY OF THE INVENTION

From the modern perspective, the traditional method of hewn log construction has certain distinctly negative features. The process of hewing the logs into square timbers is wasteful of resources and very time consuming. Because the hewn timbers are dimensionally diverse, each timber and each corner notch must be individually measured, cut and fitted. It is precisely the dimensional diversity of the material in the usual stand of timber that has prevented the serious adaptation of mass production methods to square timber construction. Either the manufacturer must take his materials from a highly selected inventory of logs to ensure dimensional uniformity in the components of the structure, or else he must revert to the traditional practice of matching each component individually. Moreover, the need to chink the space between timbers introduces a degree of uncertainty to the production process that, from the viewpoint of modern industrial method, is intolerable. Prefabrication of the traditional structure has been, for practical purposes, impossible. Square timber construction where it is practiced at all, remains a hand-crafting art requiring much time and, unfortunately, results in much waste of potentially valuable lumber that is lost in the hewing process. The invention modifies the traditional hewn log building so that prefabrication and modern production methods can be implemented in manufacturing. It retains the horizontal timber construction of the hewn log building with tongues for corner joinder. However, it introduces features that are new in the art. It takes as the primary structural art not the individual timber component but the components in paired combination with other components. It also incorporates the natural taper of the timber, or an approximation thereof, into the structural system and matches components according to degree of taper as well as length. Further, it pairs and stacks timber components (of the same length and taper) on the basis of a vertical dimension that is constant within a structure of connected walls, producing a two member assemblage in which top and bottom horizontal surfaces are parallel and equidistant. "Fillers" are required on alternate walls at the top and bottom to produce a structure that is flush at the bottom and horizontal at the roofline. The tongues are formed in the ends of the timbers of the same length as the thickness for corner joinder and of a height equal to one-quarter of the height of the matched pair are formed uniformly at a vertical distance from the horizontal surfaces in each timber to provide uniform stacking and corner joinder of matched pairs. This allows the combination of components that individually vary widely in their vertical height at corners, though the combined vertical height is the same from one pairing to another in the structure. Finally, the constant vertical height dimension of the timbers in matched pairing makes possible a uniform notch system which is a practical necessity in pre-fabrication.

The principal economic value of the invention is that it allows the utilization of logs that are unsorted by diameter. The fact that the system accomodates components of widely various heights allows the use of logs that are diverse in their diameters.

DETAILED DESCRIPTION OF THE INVENTION

In growing, trees normally lose diameter with increased height. They become narrower towards the top. The amount of taper varies significantly from species to species and also somewhat from tree to tree. In general, taller trees have less taper while shorter trees have considerably more. White pine and hemlock have relatively little taper while the normally shorter white spruce, for example, loses $\frac{1}{4}$ of an inch or more for every foot (2.08 centimeters per meter) of height. This taper has had adverse economic consequences in the wood products industry. Sawmills must waste valuable board footage to produce the rectangular construction materials markets demand. Chippers now partially redeem this loss. Yet the low value pulp commodity that is the output of the chipping process can not replace the potential value of the fiber as milled lumber. As a result, the craftsman often seeks out low taper materials such as white pine, in preference to the otherwise equally desirable white spruce that, due to its severe taper and relatively short stem, is often shunned in the wood products industry. Frequently the taper of logs is hewn away, partly or entirely, to bring the materials to more nearly uniform dimension. Often a small taper is tolerated, the craftsman taking care to alternate smaller and larger ends in the placement of one timber on top of the other. This produces a more or less even accumulation in the erection of the wall. This procedure is followed also by builders or "round log" cabins.

Figure 2:
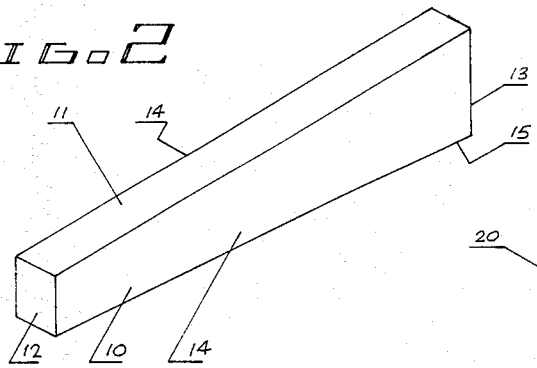
FIG. 2 is a perspective view of a timber component of the invention in its pre-notched form.

The invention, on the other hand, accepts the natural taper of the forest product and deals with it in a principled manner. In the preparation of the components utilized in this building, logs are sawn in the conventional way to the desired wall thickness, "jacket boards" being removed from the two sides. These timbers or flitches, are then sawn to the natural taper 11 of the tree (or an approximation thereof) on the two remaining bark sides producing a "cant" that has a small 12 and large end 13, as shown in FIG. 2.

An advantage thereof of sawing rather than hewing timbers "square" is the elimination of much waste through the salvaging of valuable board footage (i.e. the "jacket boards") from the sides of the log. Further, by cutting to taper, rather than reducing the log to a uniform cant, an "overrun" in board footage can be produced of between 25 and 50 percent, depending on the severity of the taper and the size and length of the material entering the saw.

Loggers customarily sort out products specifically intended for pulp mills, i.e., lengths of wood too knotty, too small, too unsound, or too crooked for use by sawmills. Sometimes veneer logs are sorted out for a special market. Sometimes loggers sort out 8-foot (3.5 meter) sawbolts (i.e. small dimensional saw logs) for which market prices obtain that are generally higher than pulp prices (although lower than prices for larger saw logs). Additionally, some sorting is done in the woods by species. But in general, and with respect to saw timber specifically, the output of the usual timber harvesting operation is a collection of materials that are unsorted for any specific end-use or end-value in manufacturing. The result is a great dimensional diversity that reflects, of course, the natural diversity of the standing timber. For in addition to the taper of trees that operates to ensure dimensional contrast within the individual specimen, there is the natural variation in size caused by differences in age, health, soil conditions, and the amount of sunlight reaching the upper branches of the tree.

The matter of diversity does not impose insurmountable limitations on the builder of the traditional hewn log house since that structure does not lend itself to mass production or prefabrication as previously discussed. Each stage of construction—from the selection of the timber to the final chinking of the assembled building—falls, in most cases, under the direct supervision of the builder. Also, each stage in the planning and execution is subject to modification as the work progresses. Some diversity in the size of timbers is tolerated, more obviously by some artisans than others. As above, the gaps between timbers could be widened or narrowed with no serious consequences. Also, timbers can be brought into closer uniformity through more liberal use of the broad axe. Moreover, the builder doubtlessly exercises careful judgment in his selection of the standing timber. The result is that the problems of dimensional diversity, as they confront the modern manufacturer, either do not arise or are self-correcting in the course of construction.

The modern prefabricator of log buildings generally (mass production of structures of the square timber type specifically has rarely been attempted) is forced, mainly by the production requirements of the corner system, to seek out highly specialized supplies of logs, a fact that helps to drive the cost to the consumer of such buildings far above the already staggering prices for conventionally prefabricated housing units.

The method of construction described here accepts the natural diversity of the growing timber. In fact, it raises it to the level of a primary requirement of the structural system. What to traditional artisans is the source of the need for much individual measurement, fitting, modification, and adjustment in the corner system and the timber components themselves (and to the modern manufacturer a persistent obstacle to mass production) is, for the building system described here, the natural basis of its structural purpose and integrity. Taking, as it does, the tapered "square timber" as its basic component, and placing only those limits on small and large end dimensions that approximate the actual limits of the growing timber, this system makes possible the fullest utilization of the tree, regardless of its degree of taper or size. It is thus able to take advantage of the more favorable price structures of woods-run saw-timber materials while being, at the same time, resource conservative in a practically meaningful sense.

In seeking to preserve a more or less uniform appearing system of corner joints, the practitioners of hewn log building construction attempted to reduce (though perhaps not eliminate altogether) dimensional diversity among the individual timbers making up any wall and adjoining wall. The reason for this is to be found in the staggered nature of the meeting of timbers at corners in most building traditions in which logs are emplaced horizontally. Whether in the hewn log or round log tradition, the corner system, for obvious structural reasons, is always a meeting of timbers in an overlapping and staggered relation, so that top and bottom horizontal surfaces of the timbers, or logs, in a wall meet the timbers, or logs, in an adjoining wall on a plane lying approximately midway between their respective top and bottom horizontal surfaces. If these surfaces meet in a precise relation, a precisely uniform system of corner joints can be devised. Conversely, any tolerance of variation among the individual timbers in their end dimension entails, in traditional practice, some sacrifice of uniformity in the system of corner joints. We confront therefore what would appear to be an immutable principle of such building practice, i.e., precise uniformity in the system of corner joints can be maintained only through the use of structural units that are themselves precisely uniform.

Figure 3:
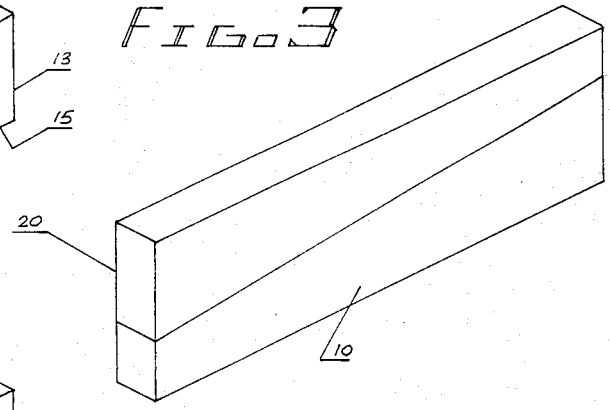
FIG. 3 is a perspective view of a matched pair of timber components of the invention in their pre-notched form.

The system described here reconciles the apparent conflict between the natural diversity of the resource and the modern production requirement of uniformity in a way that does not violate the meaning of the principle formulated above. It achieves this reconciliation by taking, as the primary structural unit of the wall, not the individual timber component 10 but rather the timber components in paired combination with other timber components. The system requires that tapered components be matched to provide a specific vertical dimension that is constant throughout all pairings in the structure but may, of course, vary from one structure to another. The matched pairing of components, shown in FIG. 3 provides the constant dimension that is necessary to allow uniformity in the system of corner joints. Thus, while the vertical dimension of the timbers in matched combination 20 is constant and equal from pair to pair, the dimensions of the individual components will vary widely. It is this feature of the system that permits extensive utilization of unsorted saw-timber materials, giving the processor of the resource an important economic advantage.

Figure 4:
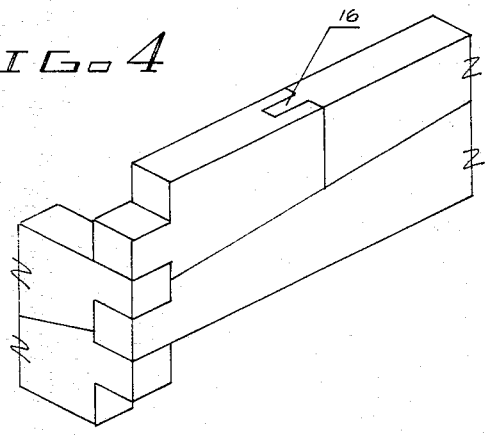
FIG. 4 is a perspective view of a corner joint of the invention utilizing simple "square notches".

FIG. 4 shows two matched pairs joined, to form a corner, by a system of simple "square notches". As shown, components may be joined at their ends 16 to form longer components that are then matched with other components or combinations of components to form pairs. A component is defined herein as either a single component, notched at each end and co-terminous with a wall, or a combination of components joined at two ends 16 as shown in FIG. 4.

Figure 5:
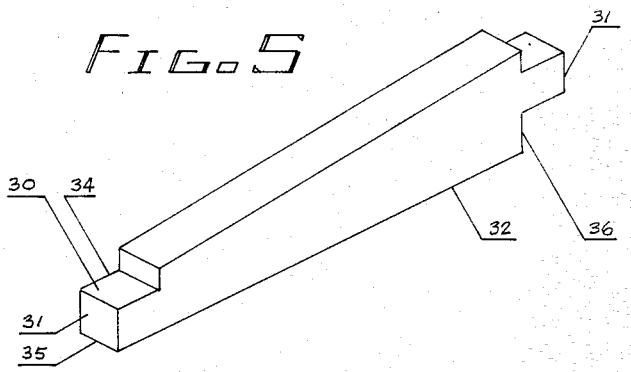
FIG. 5 is a perspective view of a timber component of the invention showing the ends tongued for "square notches".

The timber component shown in FIG. 2 is the smallest significant unit of the system presented here. It consists, in its pre-notched form, of six flat surfaces, these being two vertical and parallel end-surfaces 12 and 13, two vertical and parallel side-surfaces 14, a base surface 15 that forms angles with end-surfaces 12 and 13 that are respectively constant within a connected structure but may vary between structures, and a variable surface 11 that defines, relative to the base surface, the degree of taper of the individual component. In the completed structure base surfaces 15 are all parallel. Variable surfaces 11 between pairings are parallel only if a constant degree of taper has been selected for the structure in question. Notched timber components are invertible end-for-end so that the individual component as shown in FIG. 5 may serve as either the bottom or top member of a pair.

As shown in FIG. 4, timber components are used with other components to form matched pairs that are, in their horizontal dimension, co-terminous with a wall. The matched pair is the primary structural unit of the system. In its vertical dimension 20 it is constant throughout any wall and connecting walls, but may vary from one structure to another. This constant vertical height dimension of the matched pair is calculated approximately as twice the average vertical dimension of the components, in the active production inventory of components.

To produce a successful and complete pairing of components, the sum of their respective vertical dimensions at any point along the wall must equal the vertical height dimension of the matched pair at the corner. There must be agreement between the two components of the pair with respect to length and degree of taper, so that the lines formed by the base surfaces of the components 15 in the pair are parallel and, by reason of the vertical height 20 which remains constant, also equidistant. The degree of taper, as defined by the variable surfaces 11 of the components, is constant within the pairing but may vary between pairings. Because the large and small ends of timber components alternate at corners in the vertical assembling of the wall, variable surfaces 11 will always face variable surfaces and base surfaces 15 will always face base surfaces.

With regard to the variability of variable surfaces in the completed wall, (1) variable surfaces are variable in the sense that these internal surfaces of the matched pair, though in agreement with each other with regard to the degree of taper they define, do not necessarily correspond in this respect to the facing internal surfaces of other pairings in the wall. That is, the line formed by the variable surfaces within the matched pair is not necessarily parallel with the lines formed by the variable or internal surfaces of other pairings and (2) the vertical distance between the respective internal surfaces of contiguous pairings will vary throughout the wall (even when parallel) just as the vertical dimensional characteristics of the individual components themselves vary.

The available timber will, in general, establish certain limits with respect to component size. As before, averages in the inventory of components provide the constant vertical height dimension which is the controlling factor in the selection of components for a match. Additionally, the notching system places certain limits on the vertical dimension of the individual components at the corner. The vertical dimension of a corner-forming component at its small end must, before notching, be equal to or greater than the vertical space consumed by the tongue. Thus, the dimensions of the tongue in the interlocking corner system establishes the minimum vertical dimension of the component at its small end. The maximum vertical dimension of the component at its large end will, in turn, be established by the minimum vertical dimension of the component at its small end because the vertical dimension of the component at its large end cannot be greater than the difference between the constant vertical dimension of the matched pair 20 and the minimum vertical dimension of the timber component at the corner. The maximum large end dimension is always the difference between the vertical height 20 and the lower limit. Additionally, a constant wall thickness must be maintained throughout any wall and connecting walls. If the available timber is small-dimension, this may be only 3 or 4 inches (7.5 or 10 centimeters). Larger timber will allow walls that are 6 or even 8 inches (15 or 20 centimeters) thick.

The degree of taper will generally vary with the species of timber and, to some extent, between timber stands within the same species. Although the system permits the mixture of tapers within a wall and connecting walls (though not within the pairing), in practical terms the matching and sorting operations in production is greatly facilitated if a single species is processed at a time and if a single degree of taper is adopted for the individual structure or production series of structures.

The values for the minimum small end size, maximum large end size, and the degree of taper, together place a limit on the wall length that can be generated in a given application of the system. The maximum wall length that can be produced within a given set of parameters is determined by dividing the difference between the minimum small end size and the maximum large end size by the degree of taper. For example, if the minimum is 4.5 inches (11.43 centimeters), the maximum 13.5 inches (34.3 centimeters) and the degree of taper is one-quarter inch per lineal foot (2.08 centimeters per lineal meter), then the maximum wall length is calculated to be 36 feet (11 meters).

The key to the absolute dimensions of the tongue at corner forming timber ends is the constant vertical dimension of the matched pair 20. FIG. 5 shows the preferred tongue dimensions for a structure utilizing corners of "square notch" type. Since it is preferable to use two tongues and corresponding notches for corner joinder in a matched pair (even though other numbers of notches and tongues would interlock), the height of the tongue 31 is equal to one-fourth the vertical height of the matched pair 20. All tongues on all component ends (both small and large) have identical dimensional characteristics. Their placement, however, relative to the base surface of the component is different for large ends than for small ends. For small ends, one surface of the tongue is preferrably flush with the base surface of the component 32. For large ends, the tongue is initiated at a distance above the base surface of the component equal to the height of the tongue 31. As shown, the length of the tongue 34 (the depth of the corner connection) must equal the thickness of the wall 35. In forming corners the large end in the matched pair must be sufficiently larger than the small end with which it is matched to allow for the fact that the timber is tapered and will already have a somewhat diminished vertical dimension six or eight inches (15 or 20 centimeters) from the large end. Since the vertical distance taken up by the notch and tongue at the large end is already equal to half the constant vertical dimension of the matched pair, it is necessary that the unnotched timber component, at the large end, be larger than that at least by a fraction of an inch (a few millimeters) in most cases. The precise value can be calculated only after wall thickness and the degree of taper of the components in question have been determined since the full dimension of the tongue and notch are cut in the large end. For example, if the constant vertical dimension for a matched pair is 18 inches (45.72 centimeters) and the wall thickness is 0.5 feet (15.24 centimeters) and the degree of taper is $\frac{1}{4}$ inch per lineal foot (2.08 centimeters per lineal meter), then the minimum vertical dimension of the unnotched timber at its large end is $9\frac{1}{8}$ths inches (23.18 centimeters) calculated as $\{[\frac{1}{4}$ inch per foot of taper$]\times[0.5$ feet thickness & tongue length$]+[18$ inch per matched pair height$]\times\frac{1}{2}$ matched pair height$\}$ and metrically as $\{[2.08$ centimeters/meter$]\times[15.24$ centimeters$]+[45.72$ centimeters$]\times\frac{1}{2}\}$. Also, the length of the tongue at the timber end is determined by and equal to the thickness of the wall. The height of the tongue (at the corner) is preferrably the constant vertical height divided by four. Though called "square notches" traditionally, the tongues are not necessarily square on their surfaces. They may be longer than they are high. For example, if the constant vertical height of the pair is 18 inches (45.72 centimeters), the tongue will be 4.5 inches (11.43 centimeters) high. If the wall is 6 inches (15.24 centimeters) thick, the same tongue will be 6 inches (15.24 centimeters) long.

All internal surfaces of pairs within a wall and connecting walls must correspond with respect to the general direction of their slope, though they need not be precisely parallel. Because their notches are symmetrical, components of the "square notch" type, as shown in FIG. 5, are fully invertible, end-for-end, as well as on their horizontal axis. Thus, the components as shown will produce a wall and connecting walls in which either all internal surfaces are ascending, relative to the base lines of the pairing, or descending as the structure is viewed from left to right. Of course, all internal lines within a single structure must correspond.

Figure 1:
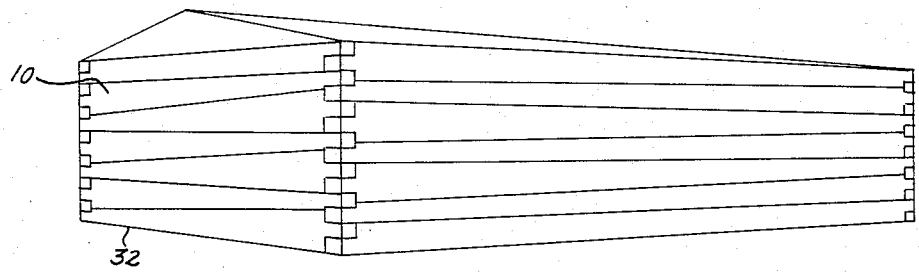
FIG. 1 is a perspective view of joined walls of a building of the invention utilizing simple "square notches".

Throughout this description, the base surfaces of matched components, i.e. the top and bottom surfaces of assembled timber pairings, are referred to variously as parallel and/or equidistant. Components of the "square notch" type, as shown in FIG. 5, can only be assembled so that the base surfaces of pairings form right angles with a vertical corner and are thus also horizontal or substantially so. Only in this way can a structure, utilizing "square notches" as described herein, be assembled so that interconnections are made at each corner. Components of the "square notch" type need only an additional "filler" component preferrably of the type shown in FIGS. 1 and 6, to produce a rectangular structure of any size having walls that are flush and horizontal at the top and at ground level. The reason the system is versatile in this respect is that the tongue, at the small end, is initiated on the same plane as the base surface of the component making possible a meeting, at the corner, of timber pairs at a distance equal to half their constant vertical dimension 41, as shown in FIG. 1. Thus, the matched pairs alternate in the four walls of the structure between only two elevations. Opposite walls have the same configuration and elevation of matched pairs and all interconnect at corner.

Figure 6:
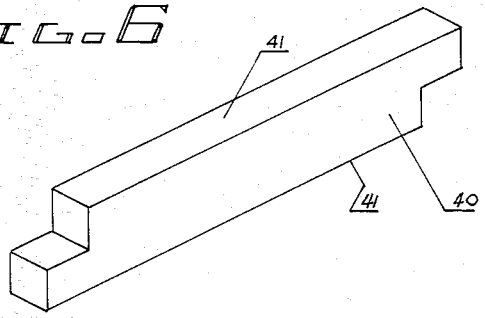
FIG. 6 is a perspective view of a filler component of the invention showing its ends "square-notched" and tongued.

For buildings utilizing "square notches", the "filler" component, as shown in FIG. 6, is not tapered. Its top and bottom surfaces 41 are parallel and its vertical dimension is equal to half the vertical dimension of the matched pair 20. The tongues at the ends of "filler" components have dimensional characteristics identical to those of the regularly tapered components. Of course, other forms of "fillers" can be employed with alternating tapered and horizontal surfaces. However, the method depicted requires but one "filler" component for a structure and is the preferred method.

To summarize, the degree of taper exhibited by the component may be constant throughout the structure or may vary within the structure between pairings. Of course, since the timber is tapered, its height varies along the entire length of the timber, producing a large end and a small end, limits on large end and small ends being placed by requirements of the tongue and notch system at the corner as well as by the constant vertical height dimension of the timbers in pairing. Although the two components of a pair will always have the same degree of taper, they will not ordinarily have the same vertical dimensions. Assuming a degree of taper of $\frac{1}{4}$ inch per lineal foot (2.08 centimeters per lineal meter), then a 16 foot (4.88 meter) component having a pre-notched small end vertical height of $5\frac{1}{2}$ inches (13.97 centimeters) will have a pre-notched large end height of $9\frac{1}{2}$ inches (24.13 centimeters) calculated as $\{5\frac{1}{2}+[16\times\frac{1}{4}]\}$. Assuming the constant vertical height dimension of the timbers in pairing to be 18 inches (45.72 centimeters), then to produce a successful matched pair, the timber in question will require another 16 foot (4.88 meter) component that is $12\frac{1}{2}$ inches (31.75 centimeters) high at its pre-notched large end $\{18-5\frac{1}{2}=12\frac{1}{2}\}$ and $8\frac{1}{2}$ inches (21.59 centimeters) high at its small end $\{18-9\frac{1}{2}=8\frac{1}{2}\}$. The timbers are thus matched. They have the same degree of taper and the same length. Though they are different in their vertical heights, the sum of their respective heights at any point along the wall will always equal 18 inches (45.72 centimeters). They are thus complementary in that the matched pair forms a rectangle having a height of 18 inches (45.72 centimeters). The fact that the components of the pair, the wall and the structure are of varying vertical heights makes it possible to utilize woods-run logs that vary in their diameter.

What is claimed is:

1. A building having interconnecting walls of horizontally stacked tapered timber members of substantially uniform thickness, each member having a large end and a small end, the large ends of such members varying ordinarily in height from one member to another and the small ends varying likewise in height from one member to another, each member having a tongue notched in each of its ends for corner joinder in a staggered relationship with like-formed members of adjoining walls, comprising:

a. said members being of the same degree of taper;

b. each member being tapered on one side throughout its length in relation to a substantially horizontal opposing side;

c. said members being arranged for uniform stacking in pairs of a fixed height, tapered side facing tapered side, large end on top of small end and small end on top of large end, producing two-member assemblages wherein top and bottom sides are parallel and substantially horizontal, said facing tapered sides of members being likewise parallel with facing tapered sides of other assemblages in the wall;

d. said members of assemblages having a tongue notched in each end for joinder in a staggered relationship with like-formed assemblages of adjoining walls;

e. said tongues being notched in the small ends of said members at a fixed vertical distance from the plane of the horizontal sides of said members;

f. said tongues being notched in the large ends of said members at a fixed vertical distance from the plane of the horizontal sides of said members;

g. said notches and tongues of stacked assemblages in one building wall being joined to fit the like-formed and equally placed tongues and notches of stacked assemblages of the same fixed height in adjoining walls.

2. The building of claim 1 wherein said tapered members vary in degree of taper between assemblages of tapered members.

3. An assemblage for constructing a building having interconnecting walls of horizontally stacked tapered timber members of substantially uniform thickness, each member having a large end and a small end, the large ends of such members varying ordinarily in height from one member to another and the small ends varying likewise in height from one member to another, each member having a tongue notched in each of its ends for corner joinder in a staggered relationship with like-formed members of adjoining walls, comprising:

a. said members being of the same degree of taper;

b. each member being tapered on one side throughout its length in relation to a substantially horizontal opposing side;

c. each member having a tongue notched in each end for corner joinder, said tongues having identical dimensions throughout interconnecting walls;

d. said tongues being notched in small ends at a constant vertical distance from the plane of the horizontal sides of said members;

e. said tongues being notched in large ends at a constant vertical distance from the plane of the horizontal sides of said members;

f. said members being arranged in a pair, tapered side facing tapered side, large end on top of small end and small end on top of large end, producing a two-member assemblage of fixed height, wherein the top and bottom sides of the assemblage are parallel and substantially horizontal for uniform stacking and for corner joinder in a staggered relationship with assemblages of the same fixed height.

4. The assemblage of claim 3 wherein said tapered sides vary in degree of taper between stacked assemblages within said building.

* * * * *